US006800812B1

(12) United States Patent
Franks, Jr.

(10) Patent No.: US 6,800,812 B1
(45) Date of Patent: Oct. 5, 2004

(54) UNIVERSAL GROUND CLAMP

(75) Inventor: George J. Franks, Jr., Inverness, IL (US)

(73) Assignee: Senior Industries, Inc., Wood Dale, IL (US)

( * ) Notice: Subject to any disclaimer, the term of this patent is extended or adjusted under 35 U.S.C. 154(b) by 0 days.

(21) Appl. No.: 10/351,829

(22) Filed: Jan. 27, 2003

Related U.S. Application Data

(63) Continuation-in-part of application No. 09/654,249, filed on Sep. 1, 2000, now Pat. No. 6,559,387.

(51) Int. Cl.[7] ..... H01R 13/46

(52) U.S. Cl. ..... 174/136; 174/51; 174/68.3; 174/135; 174/138 E; 411/175; 439/100; 439/800

(58) Field of Search ..... 174/51, 135, 40 CC, 174/35 C, 6, 136, 68.3, 55, 138 E; 439/98, 92, 100, 799, 800

(56) References Cited

U.S. PATENT DOCUMENTS 3,353,145 A 11/1967 Sodderland et al.
4,002,869 A * 1/1977 Taccetta et al. ..... 200/61.7
4,026,619 A * 5/1977 Gillemot ..... 174/51 X
4,623,204 A 11/1986 Auclair
4,626,051 A 12/1986 Franks, Jr.
4,664,469 A 5/1987 Sachs
5,131,856 A * 7/1992 Auclair ..... 439/100
5,314,343 A 5/1994 Englander
5,642,739 A 7/1997 Fareed

* cited by examiner

*Primary Examiner*—Dhiru R Patel
(74) *Attorney, Agent, or Firm*—Fitch, Even, Tabin & Flannery

(57) ABSTRACT

A universal ground clamp having a clamping strap having a series of holes to facilitate the installation of the clamp onto a wide range of structures of various shaped and sized cross-sections. A metal stud, through which the clamping strap is secured, includes a terminal portion adapted to accommodate and have secured therein a ground wire. In one form, a pair of curved plates supported upon the stud are used to form a tight clamping action of the strap about the structure to be grounded, without subjecting the strap to localized stresses or tearing, but permitting the strap to tightly encircle the structure. One of the curved plates is captivated on the strap with stops. In another form, projections extend from the strap at the hole through which the stud is inserted in order to allow the stud to be readily inserted into the hole and prevent the stud from being inadvertently separated from the strap.

19 Claims, 4 Drawing Sheets

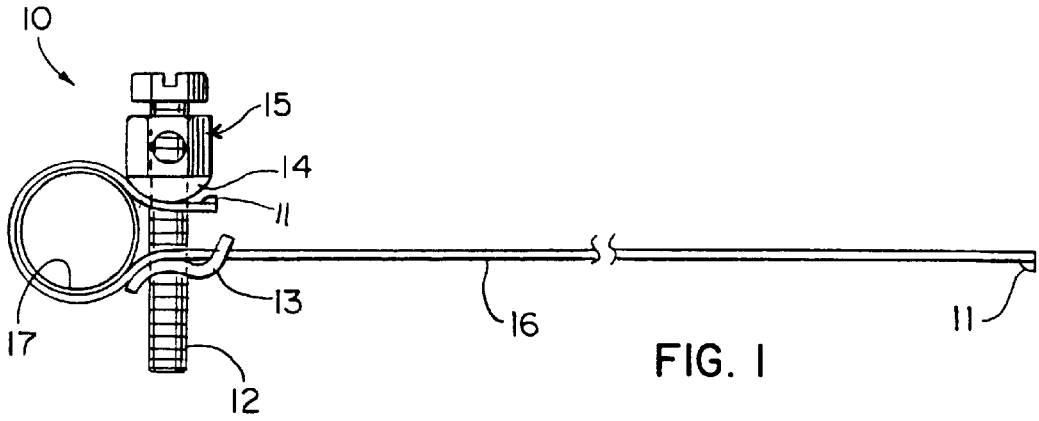
FIG. 1
FIG. 2
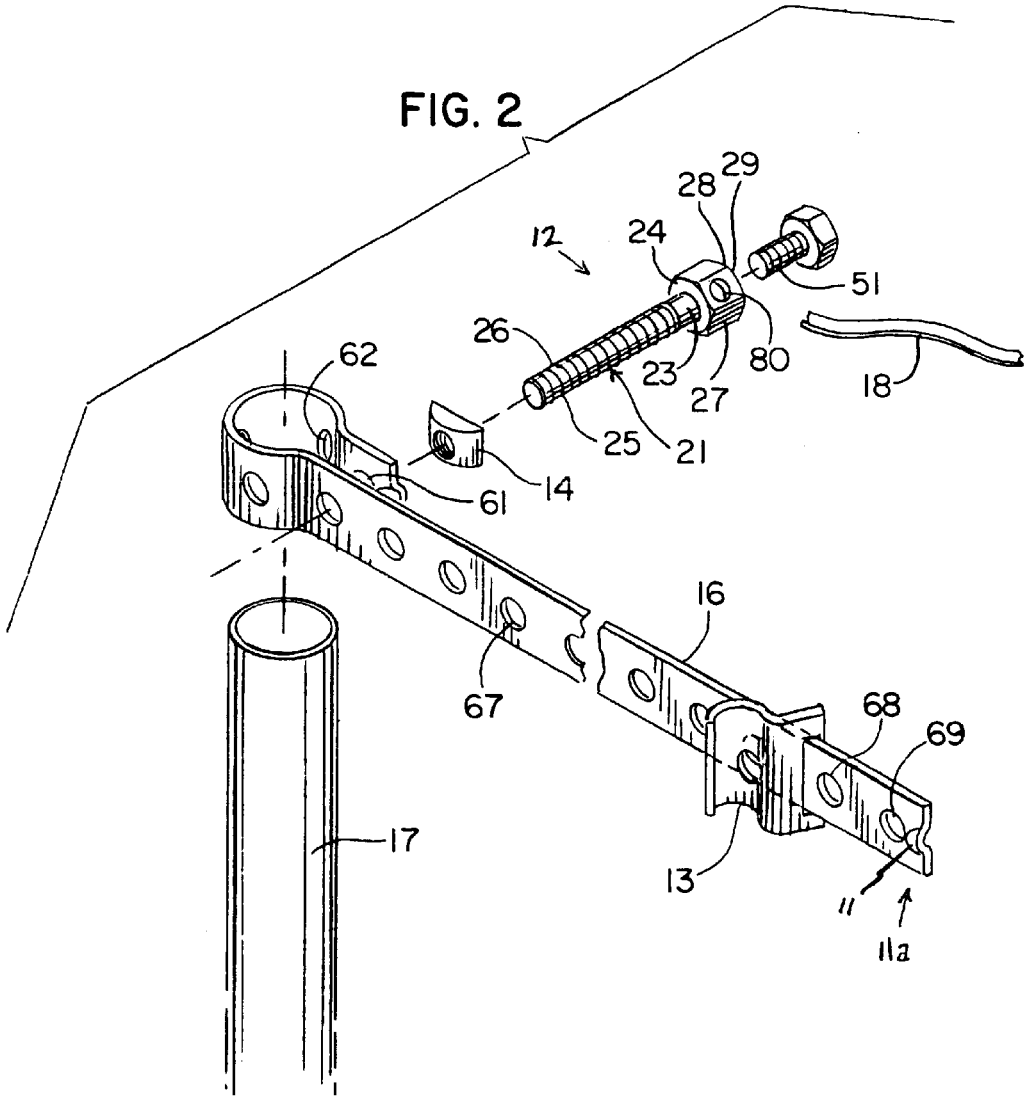

FIG. 8
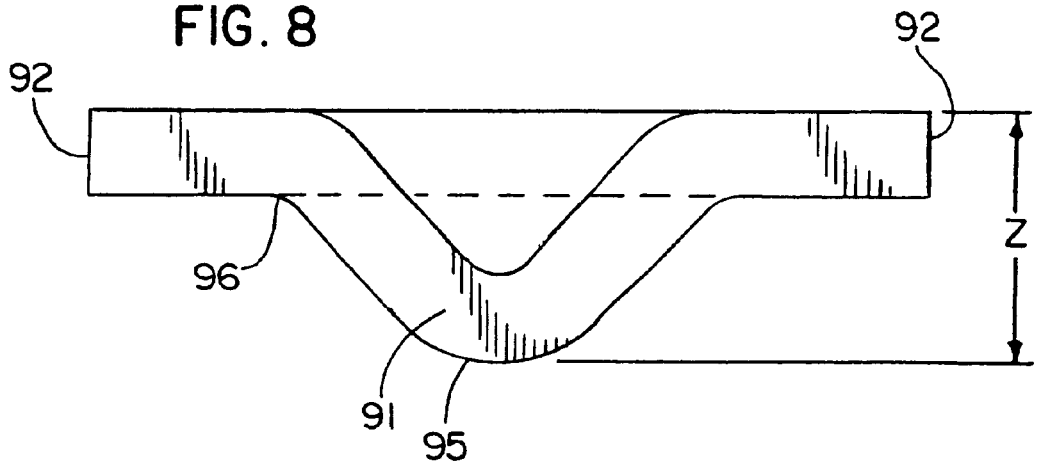
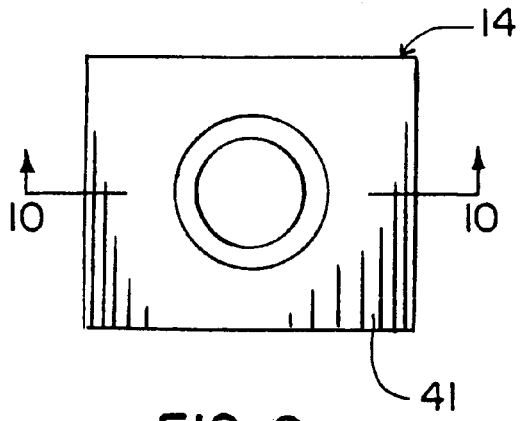
FIG. 9
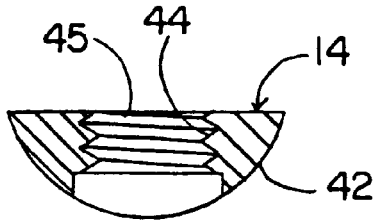
FIG. 10

UNIVERSAL GROUND CLAMP

CROSS-REFERENCE TO RELATED APPLICATIONS

This application is a continuation-in-part of application Ser. No. 09/654,249, filed Sep. 1, 2000 now U.S. Pat. No. 6,559,387, which is hereby incorporated herein by reference in its entirety.

FIELD OF THE INVENTION

The present invention relates to electrical grounding devices and, more particularly, to an universal clamp used in coupling rods, pipes or other structures of various cross-sections to ground mechanisms.

BACKGROUND OF THE INVENTION

In many instances, there is a need to provide an electrical coupling to structures of various sized and shaped cross-sections for grounding purposes. These instances include grounding of pipes, conduit, and other structures of mechanical and/or electrical systems to dissipate electrical charge to protect the systems and/or individuals who may come in contact with the components of such systems. Grounding clamps are commonly employed for these purposes.

Grounding clamps come in a variety of configurations and use various means for forming a conductive attachment. One type of clamp includes a metal strap with a plurality of holes, a metal stud, and conventional nuts to secure the strap about the periphery of the structure. More specifically, the metal strap encircles the structure and the threaded stud is inserted through two of the holes to secure the metal strap tightly around the periphery of the structure. The metal strap is drawn tightly around the periphery of the structure as the nut is tightened on the bolt. The clamp typically includes a ground terminal to which a wire is attached for connecting the clamp to a conventional ground mechanism, such as a ground rod. Strap type clamps accommodate different diameters of pipes or conduits or cross-sections of other shaped structures, such as boxes. This adaptability to a variety of structures eliminates the need for an inventory of grounding clamps that are specifically designed for a specified structure.

Strap-type clamps typically use nuts with sharp edges. These sharp edges are known to gouge the metal strap as the metal strap is tightened at the stud. This gouging causes creases and areas of weakness which severely shortens the overall life of the strap and can limit the effectiveness with which it conducts electricity.

One solution to gouging, or otherwise providing a non-destructive tightening of the strap, is disclosed in my U.S. Pat. No. 4,626,051, which discloses the use of two nuts, each having a smooth curved surface for engaging the strap. The curvature of the surface better accepts the angle of the metal strap as it leaves the various structures and attaches to the stud. While this advancement successfully prevents the gouging of the strap by eliminating the sharp edges of the engagement, one of the nuts must be removed from the stud during installation, and this leads to the possibility of losing the nut and/or lost time retrieving (if even possible) the lost nut. This situation is compounded by the fact that many installations are made in awkward and sometimes dangerous locations, such as those to suspended systems requiring installers to use scaffolding, catwalks and/or ladders to reach the suspended structures.

Another problem associated with existing strap-type grounding clamps is that the stud must be thread through the initial hole it is fed through in the metal strap in order to prevent the stud from coming apart from the strap, (e.g., in order to prevent the stud from becoming lost). Unfortunately, the threading of the stud through the hole of the strap increases installation time and keeps the installer in the awkward or dangerous positions required to install the clamp, (e.g., scaffolding, catwalks, ladders, etc.), longer than he or she need be. Alternatively, existing strap-type grounding clamps may be provided with holes through which the stud easily passes; however, such configurations are unacceptable because they increase the likelihood that the stud will be lost and/or increase installation time due to lost time retrieving (if possible) the lost stud.

Thus, the present invention addresses the need for an entirely self contained universal clamp that eliminates loose parts and the need for a more efficient method and apparatus for installing universal grounding clamps.

DESCRIPTION OF THE DRAWINGS

FIG. 1 is an elevational view of an universal ground clamp embodying features of the present invention and being attached to a structure with a circular cross-section by way of example;

FIG. 2 is an exploded perspective view of the universal ground clamp of FIG. 1;

FIG. 8 is an end elevational view of the strap of FIG. 5;

FIG. 9 is a plan view of the curved nut of the universal ground clamp of FIG. 1;

FIG. 10 is a cross-sectional view of the curved nut taken along line 10—10 of FIG. 9;

DESCRIPTION OF THE PREFERRED EMBODIMENTS

Figure 3:
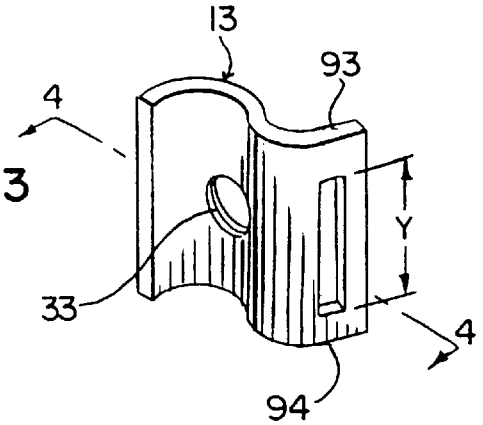
FIG. 3 is a bottom perspective view of the sliding nut of the universal ground clamp of FIG. 1.

Referring to FIG. 1, the present invention is shown embodied in an universal ground clamp 10 used as a coupling for attaching a ground to mechanical and/or electrical systems comprising conduits, pipes or other structures with various cross-sectional shapes and sizes having conductive capacity. The purpose of attaching a ground clamp 10 is to aid in dissipating electrical charge from structural components of a system, primarily for the safety and protection of the system components not intended to carry electrical charge and those coming in contact with such components.

The universal ground clamp 10 includes a stud 12, a curved nut 14 on the stud 12, a terminal ground wire assembly 15 at the stud 12, a strap 16 with end stops 11, and a sliding nut 13 captivated on the strap 16 between the stops 11. The end stops 11 prevent the nut 13 from sliding off the strap 16, and, thus, eliminates the possibility of losing the nut 13 during installation of the clamp 10.

Referring to FIGS. 1 and 2, the strap 16 is elongated to cover a range of different cross-sectional shapes and sizes. These shapes and sizes include circular, oval and even rectangular or square cross-sections. The length of the strap depends on the particular range of shapes and sizes to be accommodated. For example, with a reference to a circular cross-section, a strap length of about six inches covers a diameter range of three-eighths of an inch to two inches, a strap length of about twelve inches covers a diameter of three-eighths of an inch to three and five-eighths inches, and a strap length of about fourteen inches covers a diameter range of about three-eighths of an inch to four inches. For diameters larger than four inches, a longer strap can be used or two or more straps can be joined together to form one ground clamp.

The strap is made of any conductive material and suitable thickness that is sufficiently malleable to conform to the various shapes and sizes of the items to which the clamp may be secured. For example, both thirty-two thousandths of an inch dead soft fully annealed copper and twenty-five thousandths of an inch pre-galvanized steel are both suitable thicknesses and materials to effectively conform to the various structures.

Figure 6:
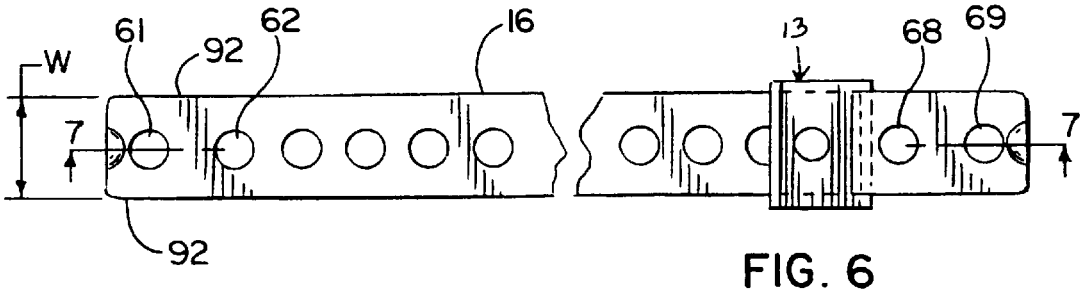
FIG. 6 is a plan view of the sliding nut captivated along the strap of the universal ground clamp of FIG. 1.
Figure 7:
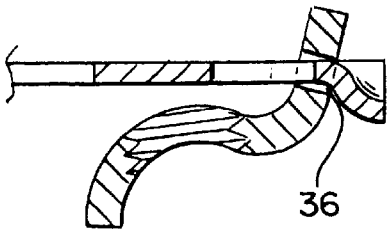
FIG. 7 is a partial cross-sectional view of the sliding nut captivated along the strap and taken along line 7—7 of FIG. 6.

To accommodate different shapes and sizes, the strap 16 includes a plurality of spaced holes along a longitudinal centerline, as illustrated in FIGS. 2 and 6. The diameter of each hole may vary depending on the diameter of the shank portion 25 of the stud 12. For example, the diameter of the holes may be about two hundred sixty-six thousandths of an inch to accommodate an outer diameter of the stud shank of about two hundred fifty thousandths of an inch.

The holes 67 are generally spaced at equal distances from each other. The number of holes in the strap depends on the length of the strap. As the strap length is increased, the number of holes is increased. For example a strap having a length of about six inches may have fourteen holes, a strap having a length of nine and one-half inches may have twenty-three holes, and a strap having a length of twelve inches may have twenty-nine holes.

Alternate spacing may also be used to space the holes adjacent the ends of the strap. For example, the spacing between the end holes can be larger. That is, the distance between the first hole 61 and the second hole 62 and the distance between the last hole 69 and the next-to-last hole 68, is larger. This enables the strap to be designed to fit a particular cross-section size at the lower end of the range for the particular clamp. In addition, for mid-range sizes, the first segment of the strap is usually about the structure, and thus, there is no need for a hole in this area. For example, the spacing between the first hole 61 and second hole 62 may be about one-half of an inch, which may be the same as the distance between the second-to-last hole 68 and the last hole 69, which may also be about one-half of an inch. The spacing between each intermediate hole 67 may be about four hundred thousandths of an inch.

The spacing of the holes is also related to the length of the stud 12. In other words, the distance between each intermediate hole cannot be greater than the length of the shank portion 25 of the stud 12. This relationship between the stud and the strap enables the clamp to accommodate intermediate cross-sections between the hole spacings.

As seen in FIG. 2, the stud 12 includes a hexagonally shaped head 27 and a shank portion 21, which includes a short, non-threaded shank portion 23 and the longer threaded shank portion 25. The non-threaded shank portion 23 is located adjacent the base 24 of the hexagonally shaped head 27. The non-threaded shank portion, however, is optional. The threaded shank portion 25 extends below the non-threaded shank portion 23 and axially along the longitudinal axis of the stud 12. The hexagonally shaped head 27 defines an internally threaded hole 28 coaxial with the longitudinal axis of the stud 12, as part of the terminal ground wire assembly 15.

The terminal ground wire assembly 15 includes a ground wire stud 51 with external threads configured to mate with internal threads 29 lining the threaded bore 28. The head 27 of the stud 12 also defines a bore 80 that extends perpendicular to the longitudinal axis of the stud 12 and passes completely through the head 27. The bore 80 is shaped to accept a stranded or solid ground wire 18 of various gauges, such as those in at least the range of fourteen to six AWG. The bore 80 may be round or elongated to accommodate larger diameter wires.

The threaded hole 28 forms a "T" with bore 80. Thus, when the ground wire 18 is inserted into the bore 80, the ground wire stud 51 is threaded into the threaded hole 28 until it engages the ground wire 18. The combination of the ground wire stud 51, the head 27 of the metal stud 12, and the "T" configured bores 28 and 80 result in the use of compressive forces to secure the ground wire 18 to the stud 12. By tending to eliminate the stresses, such as those applied when the ground wire is wrapped around a ground post, the conductive capacity of the ground wire 18 is less likely to be reduced because of the reduced chance for the wire to be frayed or split.

With reference to FIGS. 5–8, the strap 16 includes end stops 11 to captivate the sliding nut 13 to prevent inadvertent loss during installation of the clamp 10. Although the strap 16 is illustrated with stops 11 at both ends, only the stop at the free end 11*a* of the strap (FIG. 2) is necessary. The use of stops at both ends, however, facilitates ease of assembly of the clamp because then the stud can be positioned at either end, and there will be no potential for the sliding nut to become separated from the strap during installation.

As illustrated, the stops 11 take the shape of a raised partial dimple. More specifically, each of the stops has a center portion 91 symmetrically curved about the longitudinal centerline of the strap 16 with a major radius of curvature 95 and a pair of smoother curved segments 96 extending from the center portion 91 to the sides of the strap 92 with a second radius of curvature. For example, the center portion may have a radius of the curvature of about one hundred thousandths of an inch and a depth of about one hundred thousandths of an inch (dimension Z). The secondary curved portions 96 may have a radius of curvature of about thirty-one thousandths of an inch. The foregoing described stop is only one example of a stop shape contemplated by the present invention. For example, the stop may be formed with a constant radius of curvature. The stop also may include multiple dimples. Although the dimple-type configuration is formed integral from the strap, such as by conventional stamping or metal bending techniques, the stops can also be formed using separate components. For example, small protrusions, rivets, screws, tabs, studs or any other obstruction at the end of the strap to prevent the release of the sliding nut could be used in accordance with the present invention.

Figure 4:
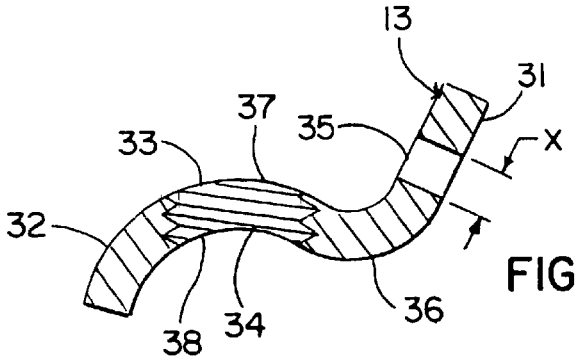
FIG. 4 is a cross-sectional view of the sliding nut taken along line 4—4 of FIG. 3.
Figure 5:
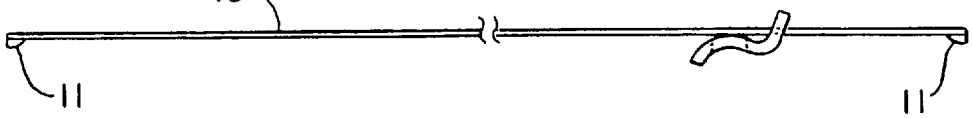
FIG. 5 is a side elevational view of the sliding nut captivated along the strap of the universal ground clamp of FIG. 1.

Referring to FIGS. 1, 3 and 4, the sliding nut 13 has a multiple curved shape with a first curved portion 32, a second curved portion 36, and a third generally straight portion 31. The first curved portion 32 defines a threaded bore 33 that cooperates with the threaded shank portion 25 of the stud 12. The straight portion 31 includes a slot 35 through which the strap 16 extends to allow the sliding nut 13 to slide along the strap 16. The second curved portion 36 positions the slot 35 such that the strap 16 is above the bore 33 of the first curved portion 32. This positioning enables a straight alignment with the holes of the strap 16.

More specifically, the radius of curvature of the first curved portion 32 of the sliding nut 13 must be generous enough to contact the strap 16 coming off the structure in a manner to ensure a smooth transition so as not to create any localized stress points on the strap, such as sharp bends creating points of weakness. For example, the radius of curvature of the first curved portion may be two hundred fifty thousandths of an inch for circular cross-sections.

The bore 33 of the first curved portion 32 is centered about the peak. The internal threads 34 of the bore 33 extend between the convex side 37 to the concave side 38 and mate with the external threads 26 of the stud 12. The slot 35 formed in the straight portion 31 extends between the sides 93, 94 of the nut 13. The slot width (dimension X) is to be greater than the thickness of the strap 16, but less than the height of the stops 11 to allow the sliding nut 13 to slide freely along the strap 16, but to prohibit passage of the stops 11. For example, using a twenty-five thousandths of an inch or a thirty-two thousandths of an inch thick strap, the slot height may be about eighty thousandths of an inch, where the stops have a height of about one hundred thousandths of an inch. The length (dimension Y) of the slot depends on the width of strap (dimension W). For example, the slot length may be seven hundred sixty thousandths of an inch for a strap with a width of about six hundred thousandths of an inch.

With references to FIGS. 1, 2, 9 and 10, the curved nut 14 remains on the stud 12. The curved nut 14 defines a central bore 45 to receive the shank portion 25 of the stud 12. The curved nut 14 is placed on the stud 12 prior to the manufacturing of the stud 12. Thus, the curved nut 14 is captivated longitudinally along the shank portion 25 at the non-threaded portion 23 of the stud 12 because the diameter of the central bore 45 is less than the outer diameter of the threaded shank portion 25. The curved nut 14 is free to rotate about the non-threaded portion 25 to properly approach the strap 16 during installation. Alternatively, the central bore 45 may have internal threads 44 that mate with the external threads 26 of the stud 12 to thread the nut 14 onto the shank portion 25 until it is in position at the non-threaded portion 23 for free rotation.

The curved nut 14 also includes a generally flat side 41 and a generally curved side 42. The nut 14 is threaded onto the threaded shank portion 25 into position with the flat side 41 adjacent to the bottom 24 of the hexagonally shaped head 27. When the flat side 41 of the curved nut 14 is adjacent to the bottom side 24 of the head 27 of the stud 12, the curved nut 14 is free to rotate independently of the stud 12. The curved side 42 facilitates the same smooth transition with the strap 16 as the first curved portion 32 of the nut 13. The diameter of the curved nut 14 is large enough to reach the outer perimeter of the hexagonally shaped head 27 portion of the stud 12. For example, the curved nut 14 may have a diameter of about two hundred fifty thousandths of an inch at the flat side where the maximum cross dimension of the head 27 of the stud 12 is about one-half of an inch. If the curved nut 14 is substantially smaller than the head 27 of the stud 12, then there is a possibility that the strap may be pinched or gouged during the transition from the pipe 17 to the stud 12.

To install the ground clamp 10, the strap 16 is wrapped around the structure, such as the illustrated conduit 17 in FIG. 2. It is manually tightened around the structure until one of the holes of the strap 16 lines up with the stud 12. The sliding nut 13 is then slid into position under the aligned hole. The stud 12 is then inserted through the hole and turned into the threaded hole 33 of the sliding nut 13 to draw the strap 16 tightly around the structure 17. A conventional tool, such as a wrench, pliers, vice grips, or the like may be used with the head 27 of the stud 12 as necessary to obtain the appropriate degree of tightness for the strap 16 about the structure. Next, the ground wire stud is turned to allow space for a ground wire to be inserted into bore 80 of the head 22 of the stud. After insertion of the ground wire, the ground wire stud 15 is tightened down by rotation to clamp the wire in the bore 80 by compressive force. The ground wire is attached to an acceptable ground mechanism.

Figure 11:
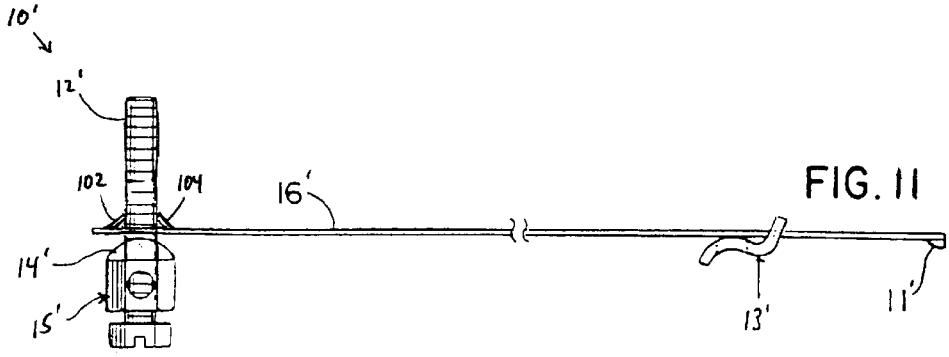
FIG. 11 is a side elevational view of an alternate universal ground clamp embodying features of the present invention showing a stud and sliding nut captivated along the strap thereof.
Figure 12:
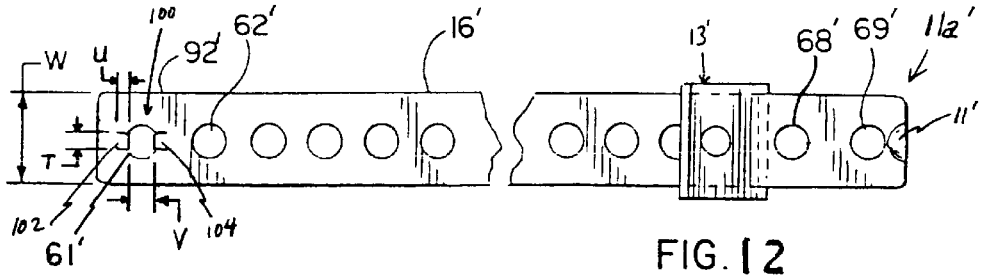
FIG. 12 is a plan view of the strap and curved strap engaging plate of alternate universal ground clamp of FIG. 11.
Figure 13:
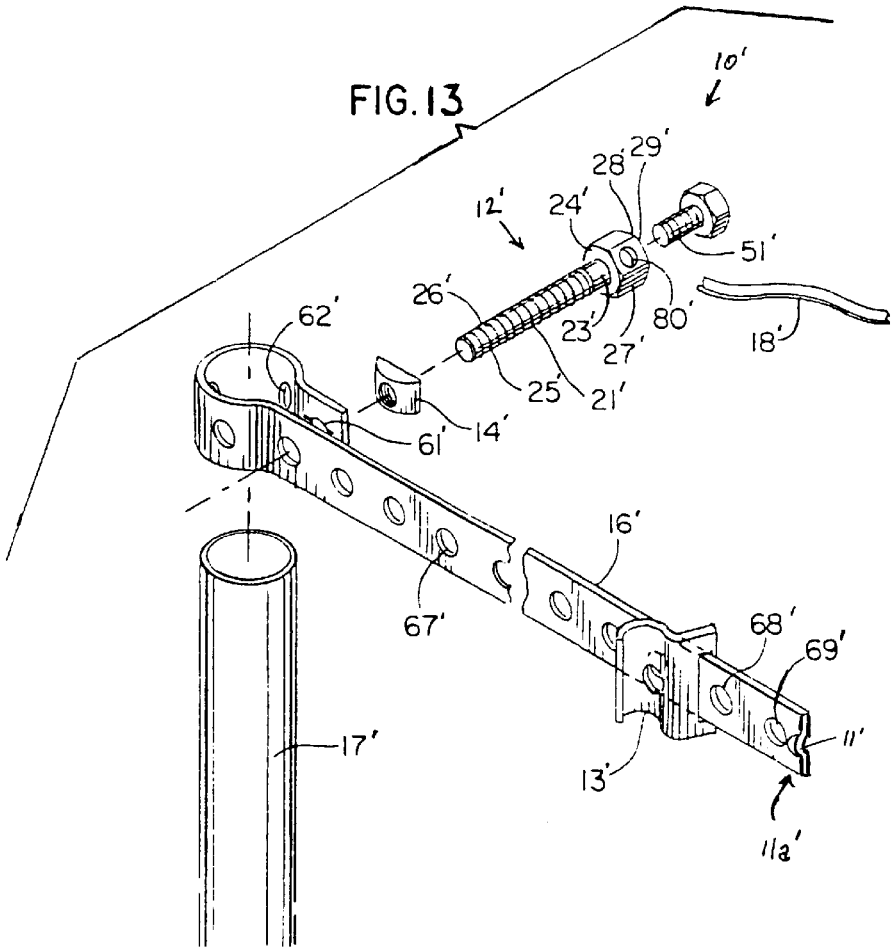
FIG. 13 is an exploded perspective view of the alternate universal ground clamp of FIG. 11.

In FIGS. 11–13, an alternate ground clamp is illustrated embodying features of the present invention. In this embodiment, the alternate ground clamp has a unique configuration designed to reduce the possibility of the stud becoming separated from the clamp assembly. For convenience, features of the alternate embodiments illustrated in FIGS. 11–13 that correspond to features already discussed with respect to the embodiments of FIGS. 1–10 are identified using the same reference numeral in combination with an apostrophe (') merely to distinguish one embodiment from the other, but otherwise such features are similar.

Turning now to FIGS. 11–13, there is illustrated an alternate ground clamp, hereinafter referred to as 10', which includes a stud securing mechanism 100. More particularly, the portion of the strap 16' which defines first hole 61' contains projections, such as tabs 102 and 104, which extend inward toward the center of the hole 61 and serve to engage at least a portion of the threads 26' of stud 12', thereby forming stud securing mechanism 100. This stud securing mechanism 100 prevents the stud 12' from coming apart from the strap 16' and, thus, reduces the likelihood of losing the stud 12' during installation of the clamp 10'.

In a preferred embodiment, the hole 61' of strap 16' has a diameter of about two hundred sixty-six thousands of an inch into which each of the tabs 102 and 104 projects by approximately twenty-three thousandths of an inch. Thus, the distance between tabs 102 and 104 (dimension V) is approximately two hundred twenty thousandths of an inch. The tabs 102 and 104 of the stud securing mechanism are preferably about one hundred twenty-five thousandths of an inch long (dimension U) and one hundred thousandths of an inch wide (dimension T). Thus, the opposing sides of tabs 102 and 104 cut into the metal strap 16' by about one hundred two thousandths of an inch. The tabs 102 and 104 are preferably formed integral to the strap 16' and, like the holes 61', 62' 68' and 69' (FIG. 12), may be cut out of the metal strap 16' via any conventional cutting or stamping process. In alternate embodiments, however, the tabs 102 and 104 may be formed using separate components or materials.

By cutting the tabs 102 and 104 out of a portion of the metal strap 16', the clamp 10' provides an amount of tab movement which allows the stud 12' to be rapidly inserted through the hole 61', rather than having to be threaded through the hole 61', which reduces the amount of time needed to install the clamp. More particularly, the tabs 102 and 104 are of a sufficient length and thickness to allow for the deflection of one or more of the tabs 102 and 104 when the stud 12' is pressed through hole 61' and continue to engage at least a portion of the stud 12' so that the stud 12' will be retained on the strap 16'.

For example, in the embodiment illustrated in FIGS. 11–13, the stud 12' may be readily pressed through the hole 61', causing the tabs 102 and 104 to flex or deflect during the insertion of the stud 12' (see FIG. 11). Once the insertion force on the stud 12' is removed, the tabs 102 and 104 remain biased against the stud 12' to engage the threaded portion 25' of the stud 12'. This prevents the stud 12' from becoming inadvertently or accidentally separated from the strap 16'. More particularly, the tabs 102 and 104 bend in the direction the stud is inserted into the hole 61' and form a one way locking mechanism which allows the stud 12' to continue to travel into the hole in the insertion direction but prevents the stud 12' from traveling through the hole 61' in the opposite direction unless forced to do so, such as by reverse threading therethrough. Thus, once the stud 12' is inserted into the hole 61' and engages the stud securing mechanism 100, the component 10' becomes an entirely self contained universal clamp.

The projections of the stud securing mechanism 100 are of a sufficient length that they can bend away from the strap 16' to allow stud 12' to be readily inserted there through, and remain in contact with at least a portion of the stud 12' in order to prevent the stud from being removed from the hole 61' in the opposite direction. The projections may be lengthened to extend further in toward the center of hole 61' so that they may provide additional resistance against movement of a stud 12' (once inserted) in a direction opposite the initial insertion direction. In a preferred embodiment, however, the projections will not extend very far in toward the center of the hole 61' in order to facilitate a fair balance between ease of insertion and resistance against unintentional removal.

In alternate embodiments of the universal ground clamp, additional holes defined by the strap may be provided with projections so that the stud can be readily inserted through any one of the additional holes and prevented from being moved in a direction opposite the direction of insertion in a manner similar to that discussed above. For example, in one embodiment of the clamp, all of the holes illustrated in FIGS. 12–13 may include projections such as tabs 102 and 104. In yet another embodiment, all of the holes except the initial hole 61' may include projections for preventing the stud 12' from being inadvertently separated from the strap 16'. Thus, with such a configuration, an entirely self contained universal clamp and a more efficient method and apparatus for installing universal ground clamps is provided.

Since the stud 12' and strap 16' are self contained via the stud securing mechanism 100, a preferred embodiment of the universal ground clamp 10' may be provided with only one end stop 11'. For example, in the embodiment illustrated in FIGS. 11–13, the universal ground clamp 10' may be provided with only one end stop, end stop 11*a*', which is located on the free end of the strap 16' and keeps the curved nut 13' captivated on the strap 16' between itself and the stud 12'. Thus, the present invention addresses the need for an entirely self contained universal clamp that eliminates loose parts and the need for a more efficient method and apparatus for installing universal grounding clamps.

The stud 12' may then be rapidly inserted into the first hole 61', flexing the tabs 102 and 104 against the threaded portions of the stud to prevent the stud from being inadvertently removed from the strap. The strap 16' may then be wrapped about the object to be electrically grounded and the threaded end of the stud 25' aligned and rapidly inserted into a second hole defined by the strap 16'. In a preferred embodiment, a nut such as the curved nut 13', is connected to the portion of the threaded end 25' extending through the second hole beyond the strap 16' so that the stud and nut may be used to tighten the clamp about the object to be grounded. In alternate embodiments, however, projections such as tabs 102 and 104 may be formed at the second hole as discussed above and may be used effectively alone as a nut for the stud so that the clamp may be tightened and secured about the object to be grounded.

While the invention has been described in the specification and illustrated in the drawings with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments illustrated by the drawings and described in the specification as the best modes presently contemplated for carrying out this invention, but that the invention will include any embodiments falling within the description of the appended claims.

What is claimed is:

1. A universal ground clamp for structures with different cross-sectional shape, comprising:

an elongated strap being capable of extending around a structure, the strap defining at least a first hole and a second hole;

a securing stud mechanism to extend through at least two of the holes of the strap to be used to tighten the strap about the structure; and at least one projection tab extending from the strap at the first hole to engage the stud and secure the stud to the strap.

2. The universal ground clamp of claim 1 wherein the at least one projection comprises first and second projections tabs extending from different side portions of the first hole for biasing against different portions of the securing stud mechanism to allow the securing stud mechanism to be rapidly inserted into the hole and prevent the securing stud mechanism from being inadvertently separated from the strap.

3. The universal ground clamp of claim 1 further comprising a strap engaging plate being supported on the securing stud mechanism and having a curved surface to engage the strap with a smooth transition.

4. The universal ground clamp of claim 1 further comprising a nut being slidingly supported on the strap and maintained on the strap by at least one end stop of the strap, having a first curved portion to engage the strap with a smooth transition, and being configured to cooperate with the securing stud mechanism to tighten the clamp between the curved surface of the strap engaging plate and the curved surface of the nut.

5. The universal ground clamp of claim 4 wherein the nut defines a slot through which the strap extends.

6. The universal ground clamp of claim 5 wherein the nut includes a straight portion that includes the slot through which the strap extends.

7. The universal ground clamp of claim 6 wherein the nut includes a second curved portion to locate the slot of the straight portion so that the strap extends over the first curved portion.

8. The universal ground clamp of claim 7 wherein the securing stud mechanism includes a threaded portion and the nut defines an internally threaded bore that cooperates with the threaded portion of the securing stud mechanism to tighten the strap about a structure.

9. The universal ground clamp of claim 8 wherein the first curved portion of the nut defines the internally threaded bore.

10. The universal ground clamp of claim 1 further comprising a terminal ground wire attachment on the securing stud mechanism.

11. The universal ground clamp of claim 10 herein the terminal ground wire attachment includes a wire clamp.

12. The universal ground clamp of claim 11 wherein the terminal ground wire clamp includes a first hole defined by the securing stud mechanism, a second hole defined by the securing stud mechanism that intersects the first hole and through which a grounding wire may be inserted, and a screw that inserts into the second hole to provide a clamping effect in the first hole.

13. The universal ground clamp of claim 1 wherein the at least one stop is formed integral with the end of the strap.

14. The universal ground clamp of claim 13 wherein the at least one stop is formed from a portion of the strap being deformed to extend out of the plane of the strap.

15. An apparatus for electrically grounding to an object comprising:

a conductive strap defining a plurality of openings, a threaded stud capable of being inserted into at least one of the plurality of openings for securing the apparatus to the object for grounding; and a projection tab extending from the strap into at least one of the openings for engaging at least a portion of the stud and for preventing the stud from being inadvertently removed from the strap.

16. An apparatus according to claim 15 wherein the projection comprises first and second tab portions extending into the at least one opening from opposite sides thereof for engaging opposing sides of the stud.

17. An apparatus according to claim 15 further comprising a nut disposed on the strap and selectively positionable about the plurality of holes for aligning with the stud and tightening the strap to the object to be grounded.

18. A method of using a grounding clamp comprising:

providing a conductive strap defining a plurality of openings, a stud for securing the strap to an object for electrically grounding, and at least one projection tab extending from the strap from at least one of the plurality of holes to engage the stud and prevent the stud from being accidentally removed from the strap;

aligning a stud with an opening in a conductive strap;

pressing the stud through the hole in the conductive strap; and flexing the projection tab extending into the hole against the stud so that the stud may be rapidly inserted into the hole and held by the strap in order to prevent the stud from being accidentally separated from the strap.

19. The method of claim 18 further comprising:

wrapping the strap about an object for grounding;

providing a nut for engaging the stud and for securing the clamp about the object for grounding; and threading the stud into the nut for securing the clamp about the object for grounding.

* * * * *